US005145071A

United States Patent [19]

Matzel et al.

[11] Patent Number: 5,145,071

[45] Date of Patent: Sep. 8, 1992

[54] PACK MADE FROM BOARD

[75] Inventors: Jürgen Matzel, Constance; Walter Schrägle; Fritz Breitenauer, both of Kempten, all of Fed. Rep. of Germany; Richard Harbour, Upton, United Kingdom

[73] Assignee: Lever Brothers Company, New York, N.Y.

[21] Appl. No.: 626,929

[22] Filed: Dec. 13, 1990

[30] Foreign Application Priority Data

Dec. 22, 1989 [DE] Fed. Rep. of Germany ..... 3942445
Jul. 25, 1990 [DE] Fed. Rep. of Germany ..... 4023622

[51] Int. Cl.[5] ..... B65D 33/20
[52] U.S. Cl. ..... 229/200; 229/924
[58] Field of Search ..... 206/604, 630, 608, 628, 206/626, 620, 621

[56] References Cited

U.S. PATENT DOCUMENTS

| | | | |
|---|---|---|---|
| 1,115,060 | 10/1914 | Eaton | 206/620 |
| 1,297,739 | 3/1919 | Schendel | 206/620 |
| 1,940,849 | 12/1933 | Davidson | 206/630 |
| 2,403,047 | 7/1946 | Buttery | 206/626 |
| 3,301,391 | 1/1967 | Guyer | 206/626 |
| 4,159,079 | 6/1979 | Engdahl, Jr. | 229/132 |
| 4,260,061 | 4/1981 | Jacobs | 206/626 |
| 4,613,046 | 9/1986 | Kuchenbecker | 206/630 |
| 4,949,845 | 8/1990 | Dixon | 206/628 |

FOREIGN PATENT DOCUMENTS

| | | | |
|---|---|---|---|
| 1296083 | 5/1969 | Fed. Rep. of Germany | 229/132 |

*Primary Examiner*—Stephen Marcus
*Assistant Examiner*—Christopher McDonald

[57] ABSTRACT

Pack made from board for free-flowing products such as detergent, with two side panels, a front panel, a back panel, a base and a closure flap which is hinged to the back panel and under which further flaps hinged to the other panels are located, where the flap hinged to the front panel extends across the whole cross-section of the pack and has a tab hinged to it that rests against the inside of the closure flap. The flap (24) hinged to the front panel (3) has parallel score lines (27, 28) provided at least to some extent in duplicate and located a short distance from the top edges of the two side panels (4, 5) which also extend across the hinged tab (26) and act as tear lines. Sections (19, 20, 21) that overlap the side panels (4, 5) and the front panel (3) to at least a small extent are provided on the closure flap (17), the section (21) overlapping the front panel (3) being provided with a tab (32), in the area of which this section is glued to the front panel for subsequent separation (31).

8 Claims, 4 Drawing Sheets

PACK MADE FROM BOARD

The invention relates to a pack made from board for free-flowing products such as detergent, with two side panels, a front panel, a back panel, a base and a closure flap which is hinged to the back panel and under which further flaps hinged to the other panels are located, where the flap hinged to the front panel extends across the whole cross-section of the pack and has a tab hinged to it that rests against the inside of the closure flap.

Such a pack is described in U.S. Pat. No. 3 543 997, where a further flap is hinged to the front panel which closes the pack to a large extent but does not make it tight.

FR-A-755 181 also discloses a pack that is relatively tight, but has a complicated folded closure and is difficult to open as well.

The purpose of the invention is to design a pack of the above-mentioned kind in such a way that it is also suitable for free-flowing products, such as detergent. It needs to be tight enough when closed so that the detergent cannot escape, it must be easy to open without the use of a tool and it must be reclosable to be tight to some extent once some of the contents have been removed.

In the solution to this problem proposed by the invention, the flap hinged to the front panel has parallel score lines provided at least to some extent in duplicate and located a short distance from the top edges of the two side panels which also extend across the hinged tab and act as tear lines and sections that overlap the side panels and the front panel to at least a small extent are provided on the closure flap, the section overlapping the front panel being provided with a tab, in the area of which this section is glued to the front panel for subsequent separation.

The sealing flap can be opened along these score lines, which do not affect pack tightness as they do not go all the way through the board material. The edge strips that remain help to stabilise the opened pack.

A closure is also created that is particularly easy to open but that nevertheless guarantees a sufficiently reliable and tight enough closure.

In an advantageous further development of the invention, the flap hinged to the front panel is provided on the underneath with a score line in the area of the hinge line of the tab, at least one creased section is provided on the top in the area of the two ends of the hinge line and the score line is interrupted in the area of these creased sections.

This makes the flap even easier to fold together, which improves tightness in the folding area; it can, however, be torn out very easily as well to open the pack.

It is also very advantageous if in accordance with the invention flaps hinged to the two side panels are folded in between the flap hinged to the front panel and the closure flap and extend at most to the score lines provided in the lower flap that serve as tear lines.

When these two flaps hinged to the side panels are folded in, they can as a result support themselves on the large flap hinged to the front panel, so that they are held very securely and thus help to increase tightness as well.

In another further development of the invention, the flaps hinged to the side panels are bevelled at their end facing the hinge line of the closure flap and the score lines extend along the free edge of the flaps and follow at least some of the bevelled section.

As a result, the edges of the two flaps act at the same time as a ruler for the tearing operation, which facilities tearing the pack open even more.

It is also very advantageous if in accordance with the invention the flaps are glued to the top of the flap hinged to the front panel.

This increases stiffness and thus leads to a further improvement in pack tightness.

It can also be provided in accordance with the invention that the tab hinged to the inner closure flap is glued to the inside of the outer closure flap in the side area divided off by the score lines.

The edge strips remain attached to the closure flap via these side areas with the result that torsional strength is increased.

It is particularly easy to open the closure if in accordance with the invention the section overlapping the front panel is provided with a tab, in the area of which this section is glued to the front panel for subsequent separation.

It has proved to be particularly favourable here if in accordance with the invention an essentially circular or oval score line, inside which the glued join is made, is provided in the front panel and/or in the tab.

When the pack is opened, the material inside this score line tears, making it unnecessary for the glued join itself to separate, so that this operation is particularly simple to carry out.

Two embodiments of the invention are illustrated in the drawings.

Figure 1:
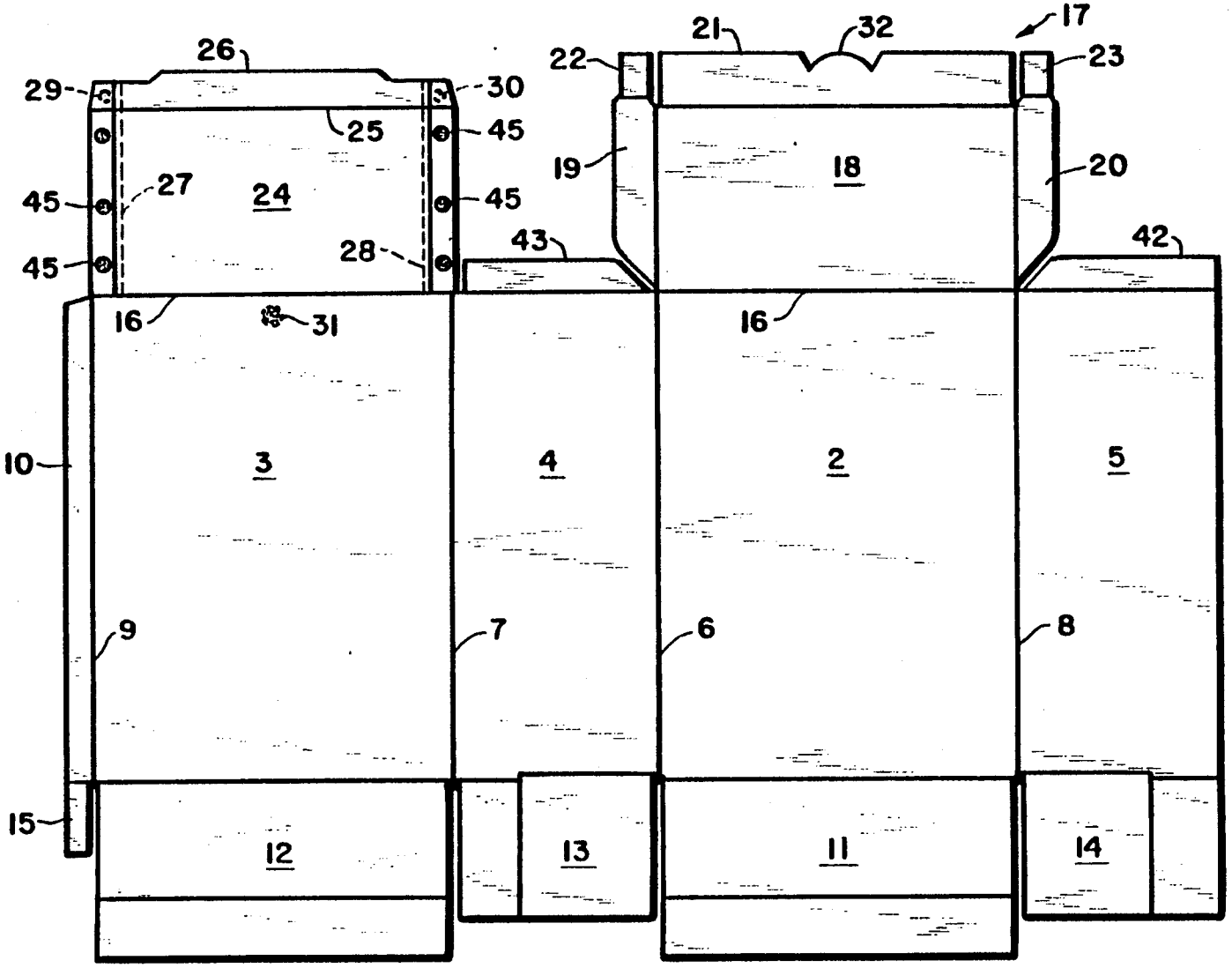
FIG. 1 shows a flat board blank

1 in FIG. 1 is a board blank, which has a back panel 2, a front panel 3 and two side panels 4 and 5. These panels are connected along folding lines 6, 7 and 8. A strip of material 10, which is connected to the side panel 5 in a longitudinal seam, is provided on the front panel 3 along a further folding line 9. Flaps 11 to 15, which can be joined to form the base of the pack, are hinged to the back panel 2, the front panel 3, the two side panels 4 and 5 and the strip of material 10.

A closure flap 17, which consists of a top panel 18, two side panel sections 19 and 20, a front panel section 21 and two connection tabs 22, 23, is hinged to the top end of the back panel 2 along a folding line 16.

A flap 24, to which a tab 26 is hinged along a further folding line 25, is hinged to the front panel 3—also along the folding line 16. Both the flap 24 and the tab 26 hinged to it are divided up by two score lines 27 and 28 that extend parallel to the side edges.

Inside the sections of the tab 26 divided off by the score lines 27 and 28 two glued areas—numbered 29 and 30 in phantom—are provided, with which the tab is attached to the inside of the top panel 18 of the closure flap 17.

A further gluing area is provided inside a circular score line 31, which is located in the top section of the front panel 3 and where the front panel section 21 of the closure flap 17 is glued to the front panel within a tab 32 provided on the closure flap 17.

Figure 2:
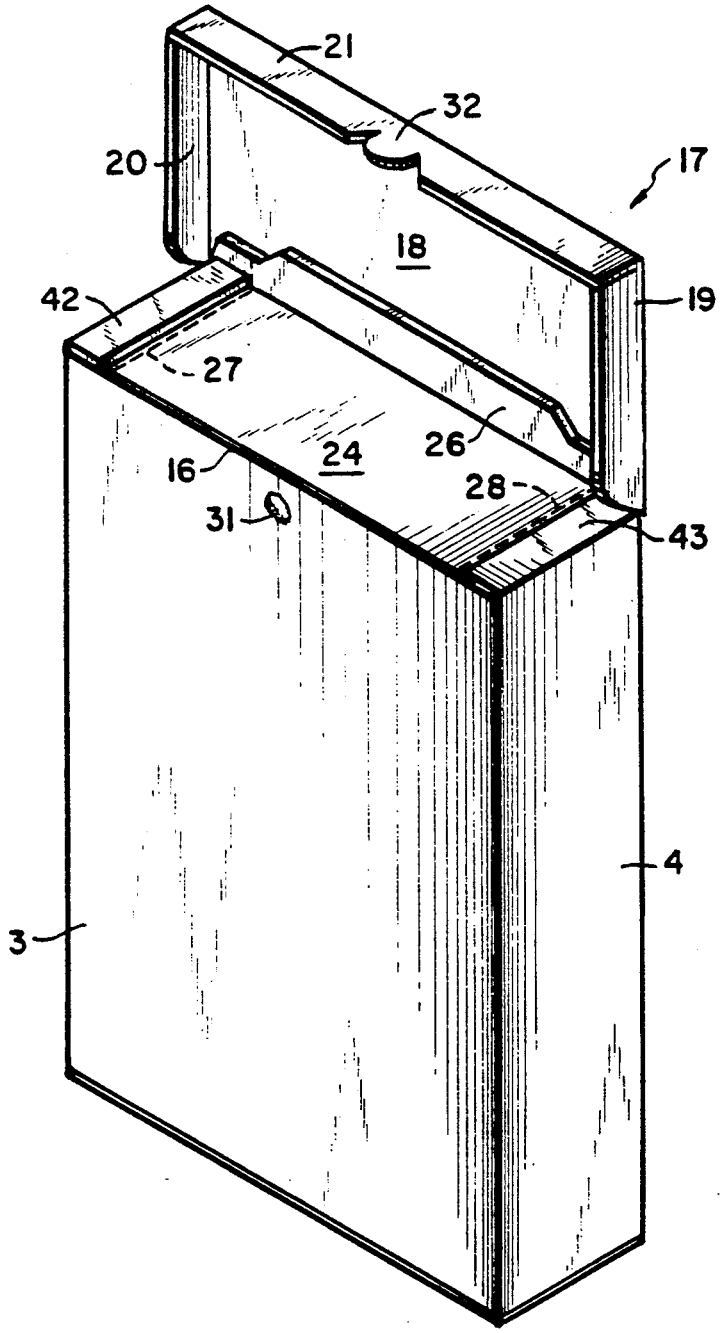
FIG. 2 shows a pack erected from the board blank illustrated in FIG. 1

FIG. 2 shows an erected, filled and closed pack, where the closure flap 17 has been opened again. To do this, the tab 32 was taken hold of and the board material inside the circular score line 31 was torn, so that the closure could be lifted open.

To open the pack further the tab 26 is now taken hold of and the flap 24 is torn along the score lines 27 and 28 so that the flap 24 can also be pulled up.

Now it is possible to remove this flap 24 completely along the folding line 16, in order to make it particularly easy to remove the product. This flap 24 can, on the other hand, remain attached to the pack instead in order to provide a more effective seal during continued storage, for moisture-sensitive products in particular. To make this possible, the two score lines 27 and 28 can be provided in duplicate, i.e. one is applied from above and the other a short distance away from below, so that an area is left for the flap 24 to rest on even when the score lines have been torn open.

Figure 3:
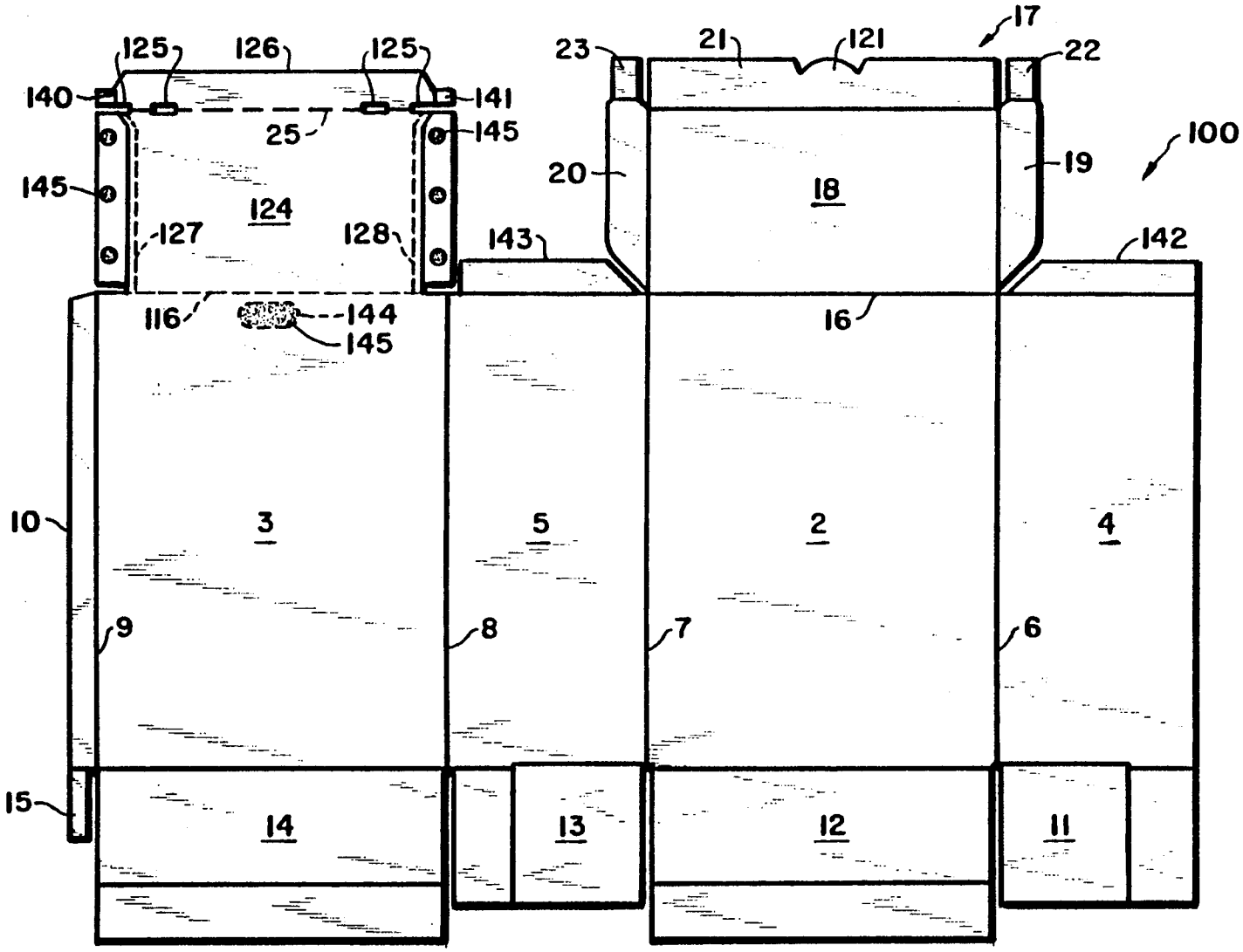
FIG. 3 shows a further flat board blank.

In the second embodiment shown in FIG. 3, 100 is a board blank, which has a back panel 2, a front panel 3 and two side panels 4 and 5. These panels are connected along folding lines 6, 7 and 8. A strip of material 10, which is connected to the side panel 4 in a longitudinal seam, is provided on the front panel 3 along a further folding line 9. Flaps 11 to 15, which can be joined to form the base of the pack, are hinged to the back panel 2, the front panel 3, the two side panels 4 and 5 and the strip of material 10.

A closure flap 17, which consists of a top panel 18, two side panel sections 19 and 20, a front panel section 21 and two connection tabs 22, 23, is hinged to the top end of the back panel 2 along a folding line 16.

A flap 124, to which a tab 126 is hinged along a further folding line 25, is hinged to the front panel 3—also along the folding line 16. This folding line 25 is provided from underneath as a score line which is interrupted from the top by four creased sections 125. In the area of the flap 124, the folding line 16 is provided with a perforation 116, which facilitates separation of the flap from the front panel. Both the flap 124 and the tab 126 hinged to it have two score lines 127 and 128 which are provided to tear the pack open and are provided in duplicate—i.e. scored once from above and below in each case—in the area of the flap 124. For most of their length these score lines 127 and 128 extend parallel to the outside edges of the flap 124 and then run obliquely outwards close to the tab 126 before extending parallel to the outside edges again.

Figure 4:
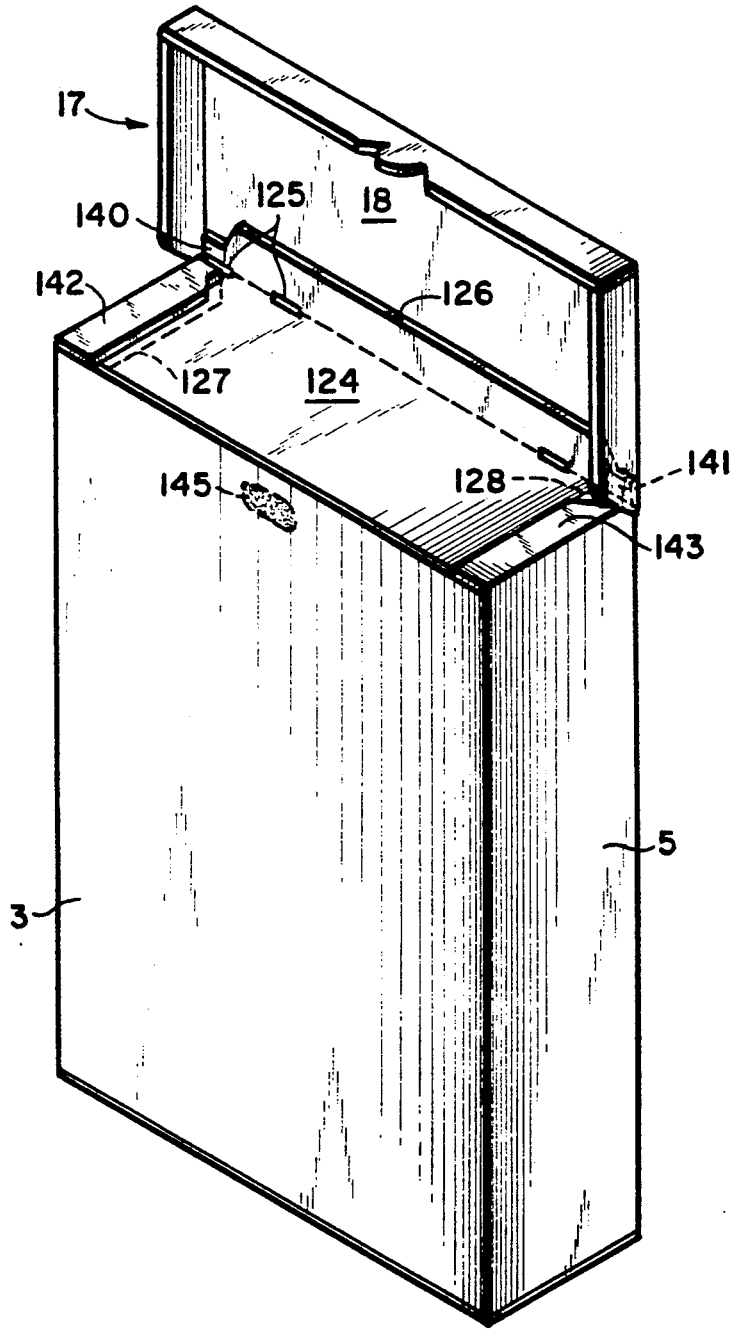
FIG. 4 shows a pack erected from the blank illustrated in FIG. 3

FIG. 4 shows an erected, filled and partly closed pack where the closure flap 17 is still open.

The closure of the top section is visible: first of all, the flap 124 is folded into position so that its tab 126 rests against the top panel 18 of the closure flap 17. The two corner sections 140, 141 have been positioned to rest against the top panel 18 and can be glued to the same. The two strip-like flaps 142 and 143 hinged to the side panels 4 and 5 have then been folded onto the flap 124 and glued to the same. The free outside edges of these two flaps 142 and 143 extend parallel to and a very short distance away from the score lines 127, 128, so that their edges serve to facilitate opening.

When the closure flap 17 is shut, section 121 of the closure flap 17 is glued to the section 145 defined by a score line 144 in the front panel, as a result of which the closure flap is held securely.

When the pack is opened, this glued join is separated first by tearing the material inside the score line 144 and then the closure flap is raised to the position shown. The back end of the flap 124 is then taken hold of and torn along the score lines 127 and 128, after which it can be removed completely along the perforation 116. The edge strips of the flap 124 that remain and the flaps 142 and 143 glued to them give the pack good dimensional stability even after it has been opened.

We claim:

1. Pack made from board for free-flowing products such as detergent, with two side panels, a front panel, a back panel, a base and a closure flap which is hinged to the back panel and under which further flaps hinged to the other panels are located, where the flap hinged to the front panel extends across the whole cross-section of the pack and has a tab hinged to it that rests against the inside of the closure flap, wherein the flap (24) hinged to the front panel (3) has parallel score lines (27, 28) provided at least to some extent in duplicate and located a short distance from the top edges of the two side panels (4, 5) which also extend across the hinged tab (26) and act as tear lines, and wherein sections (19, 20, 21) that overlap the side panels (4, 5) and the front panel (3) to at least a small extent are provided on the closure flap (17), the section (21) overlapping the front panel (3) being provided with a tab (32), in the area of which this section is glued to the front panel for subsequent separation (31).

2. Pack according to claim 1, wherein the flap (124) hinged to the front panel (3) is provided on the underneath with a score line in the area of the hinge line (25) of the tab (126), wherein at least one creased section is provided on the top in the area of the two ends of the hinge line (25) and wherein the score line is interrupted in the area of these creased sections.

3. Pack according to claim 1, wherein flaps (142, 143) hinged to the two side panels (4, 5) are folded in between the flap (124) hinged to the front panel (3) and the closure flap (17) and extend at most to the score lines (127, 128) provided in the lower flap (124) that serve as tear lines.

4. Pack according to claim 3, wherein the flaps (142, 143) hinged to the side panels (4, 5) are bevelled at their end facing the hinge line of the closure flap (17) and wherein the score lines (127, 128) extend along the free edge of the flaps (142, 143) and follow at least some of the bevelled section.

5. Pack according to claim 3, wherein the flaps (142, 143) hinged to the side panels (4, 5) are glued to the top of the flap (124) hinged to the front panel (3).

6. Pack according to claim 2, wherein the tab (26, 126) hinged to the inner closure flap is glued to the inside of the outer closure flap (17) in the side area (29, 30; 140, 141) divided off by the score lines (27, 28; 126, 127).

7. Pack according to claim 1, wherein the section (21) overlapping the front panel (3) is provided with a tab (32, 121), in the area of which this section is glued to the front panel (3) for subsequent separation.

8. Pack according to claim 7, wherein an essentially circular or oval score line (31, 144), inside which the glued is made, is provided in the front panel (3) and/or in the tab (32, 121).

* * * * *